United States Patent [19]

Simmons

[11] Patent Number: 4,984,364

[45] Date of Patent: Jan. 15, 1991

[54] DISPOSABLE REFRIGERATED SAFETY RAZOR HEAD

[76] Inventor: Richmond R. Simmons, 1296 B Stoneridge Dr., Columbus, Ohio 43213

[21] Appl. No.: 362,168

[22] Filed: Jun. 6, 1989

[51] Int. Cl.[5] ..... B26B 21/00; B26B 19/44; B26B 21/40; B65D 81/24

[52] U.S. Cl. ..... 30/32; 30/41; 30/47; 206/208

[58] Field of Search ..... 30/30, 32, 41, 47, 329, 30/140; 206/208, 228, 229

[56] References Cited

U.S. PATENT DOCUMENTS

| | | | |
|---|---|---|---|
| 3,759,594 | 9/1973 | Cobb | 206/208 |
| 4,069,580 | 1/1978 | Cartwright et al. | 30/32 |
| 4,302,876 | 12/1981 | Emmett | 30/47 |
| 4,716,652 | 1/1988 | Cataudella | 30/41 |
| 4,733,467 | 3/1988 | Borenstein | 30/41 |

*Primary Examiner*—Douglas D. Watts
*Assistant Examiner*—Paul M. Heyrana
*Attorney, Agent, or Firm*—Porter, Wright, Morris & Arthur

[57] ABSTRACT

A perforated partition is mounted in a disposable razor head housing in angular relation to the blade, thereby defining with the housing a refrigerant-receiving chamber disposed in surrounding relation to the blade. A wall is mounted in the housing in spaced, parallel relation to the perforated partition to define an expansion chamber. One or more capped ports are provided in the housing to introduce a refrigerant which is a non-toxic freezable solution typically used to cool lunch boxes.

11 Claims, 1 Drawing Sheet

DISPOSABLE REFRIGERATED SAFETY RAZOR HEAD

BACKGROUND OF THE INVENTION

The present invention relates generally to safety razors which are disposable in whole or in part, and more particularly to the blade-bearing head portions thereof.

For several years, disposable, safety razors have either been equipped with disposable blade bearing heads or have been disposable in their entirety While many advances have been made in blade sharpness and shaving comfort, it is still necessary to replace either the blade head or the entire razor relatively frequently since current blades tend to lose their edge quickly Inevitably, the user runs out of new blade heads or razors and is faced with the inconvenience and expense of traveling to the store and buying more and/or suffering through another dull shave Under the circumstances, the possibility of a blade maintaining its keen edge for a substantially longer period of time attracted the present inventor.

It is well known that a sharp edge wears more slowly at lower temperatures, all else being equal. Accordingly the inventor grew accustomed to placing his disposable razor in the freezer until ready for use. While this technique improved the longevity of the razor's cutting edge, it was impossible to sustain the conventional blade's low temperature during the shaving process. Contact with warm water and the user's face quickly raised the temperature of the thin blade. Thus, the present inventor was faced with the problem of maintaining a low blade temperature throughout the shave.

SUMMARY AND OBJECTS OF THE INVENTION

The present invention represents an improvement in a disposable razor head equipped with a synthetic resin housing and with at least one metal blade having an exposed cutting edge disposed in a gap in the housing. The subject improvement basically comprises a partition mounted within the housing in angular relation to the blade and defining in combination with the housing, at least one refrigerant receiving chamber in which a substantial portion of the blade is disposed.

A primary object of the present invention is to provide a disposable razor head which will maintain a keen edge substantially longer than heretofore possible Another object of the present invention is to provide an economical disposal safety razor which requires substantially less frequent replacement than conventional disposable safety razors A further object of the present invention is to provide a long-lasting disposable safety razor head that is relatively inexpensive to manufacture. Further objects and advantages of the present invention may become more readily apparent in light of the drawings and description of the preferred embodiment set forth below.

DETAILED DESCRIPTION OF THE PREFERRED EMBODIMENTS

Figure 1:
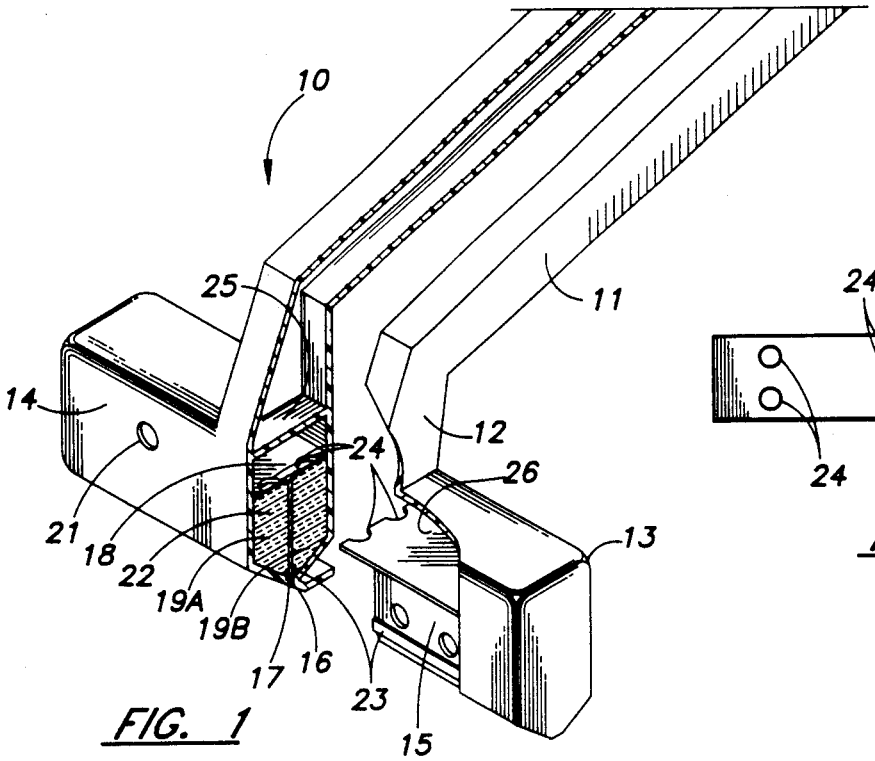
FIG. 1 is a fragmentary perspective view of a disposable safety razor equipped with a head portion according to the present invention.

As indicated in FIG. 1, a disposable safety razor, generally designated 10, is equipped with a handle 11, a neck 12, and a head 13. Preferably, the razor 10 is a unitary structure molded or otherwise formed from relatively inexpensive synthetic resin material. Alternatively, the plastic head 13 may be readily detachable from a plastic or metal clad neck 12 in a manner well known in the art.

In any event, the razor head 13 includes a synthetic resin casing or housing 14 and at least one metal blade 15, such as chromium or stainless steel. The blade 15 has an exposed cutting edge 16 disposed in a gap 17 in said housing.

The present invention basically comprises a partition or baffle 18 mounted within the housing 14 in angular fashion relative to the blade or blades 15 so as to define, in combination with the housing 14 at least one refrigerant-receiving chamber 19 in which a substantial portion of the blade 15 is disposed.

Figure 4:
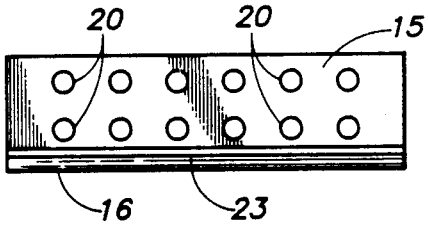
FIG. 4 is a top plan view of the blade disposed within the present razor head.

As further indicated in FIG. 1, the partition 18 may be mounted in the housing in generally perpendicular and adjoining relation to the blade 15 so as to define first 19A and second 19B refrigerant receiving chambers on opposite sides of the blade. In this arrangement, the blade 15 is preferably formed, as indicated in FIG. 4, with a plurality of perforations 20 for the reasons set forth below.

Figure 3:
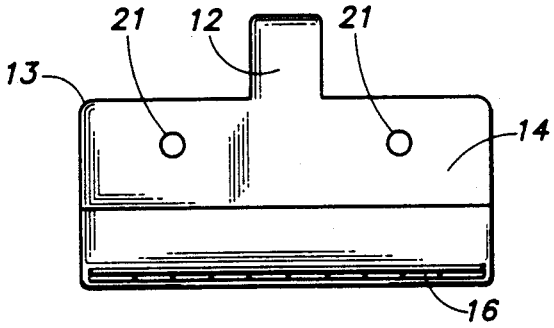
FIG. 3 is a top plan of the present razor head.

As indicated in FIGS. 1 and 3, the housing 14, is preferably provided with one or more ports in each of which a plug or cap 21 is removably mounted. These ports provide access to one of the refrigerant-receiving, blade-cooling chambers 19A. The refrigerant or coolant 22 is preferably a non-toxic substance which absorbs more heat during melting than water, such as BLUE ICE supplied by Rubbermaid Specialties, Inc., or other product typically used as a coolant in lunch boxes and picnic coolers. The coolant 22 is introduced while in liquid form through the port or ports in the housing 14, enters the chamber 19A, flows through the perforations 20 in the blade 15 and enters the chamber 19B. Eventually, both chambers 19A and 19B become substantially filled.

As may be readily understood, at least a portion of the refrigerant 22 thaws during the shaving process, so it is preferable to provide a generally fluid tight seal between the housing 14 and the blade 15 adjacent to the cutting edge 16. Such a seal may be accomplished as indicated in FIGS. 1 and 4, by providing a thin film or gasket 23 of synthetic resin material on each side of the blade adjacent to the cutting edge 16. Alternatively, the gap 17 and blade 15 may be manufactured to sufficiently close tolerances to provide a fairly uniform interference fit therebetween. In the event that small quantities of the refrigerant 22 leak out of the gap 17, such quantities may be replaced via the resealable caps 21.

Figure 2:
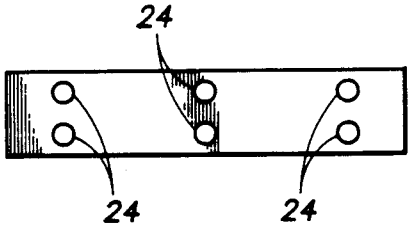
FIG. 2 is a top plan view of the partition disposed within the present razor head.

As indicated in FIGS. 1, 2 and 3, the partition 18 may be provided with a plurality of openings 24, and a solid reinforcing wall 25 may extend between opposing portions of the housing 14 in spaced parallel relation to the partition 18. In this manner, an expansion chamber 26 is provided between the partition 18 and the reinforcing wall 25 so that the refrigerant 22 can expand as it liquifies or freezes, depending upon its composition, thereby preventing damage to the housing 14 or any of the above described internal parts of the razor head 13.

Figure 5:
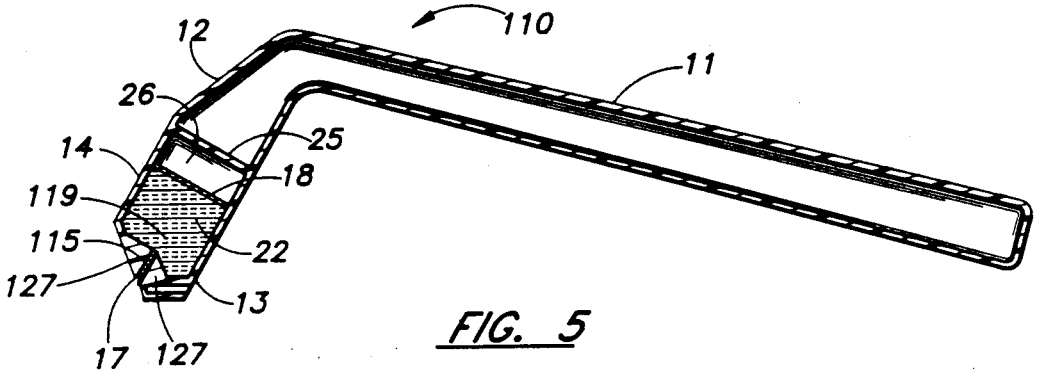
FIG. 5 is a vertical sectional view of an alternative embodiment of the subject razor head and associated handle.

FIG. 5 discloses an alternative embodiment of the present razor, generally designated 110, wherein like parts are designated by the same numbers as previously employed. In the alternative embodiment, however, a substantially narrower, unperforated blade 115 is employed and a substantial amount of space is provided between the blade 115 and the partition 18. Accordingly, a single refrigerant receiving chamber 119 is provided with surrounds the blade 115 except for the cutting edge thereof. A plurality of relatively spaced apart ribs 127 project inwardly from the housing 14 on opposite sides of the gap 17 to support and hold the blade 115 in place.

The razor 10, 110 is operated in the following manner. Initially, the razor or head 13, if it is a separate unit, is titled so that all of refrigerant 22 is able to flow through the partition 18 and into the blade-cooling chambers 19A, 19B or 119. Coolant is the added and the unit is placed in a freezer compartment in a manner substantially as shown in FIGS. 1 and 5 with the razor head resting upon a portion of the housing 14 disposed immediately below the gap 17. In this manner, the coolant 22 converts to a frozen state while remaining in the refrigerant-receiving chamber or chambers. The razor 10, 110 is now ready for shaving in the usual manner and should be employed as rapidly as possible after removal from the freezer. Once the shave is completed and the razor is cleaned, the above described tilting, filling and freezing operations may be repeated.

In this manner, the present invention provides a disposable safety razor head and or complete razor which maintains a sharp cutting edge far longer than heretofore possible.

While alternative embodiments of the present invention have been illustrated and described in some detail, the foregoing disclosure is not intended to unduly limit the gist or spirit of the invention nor restrict the scope of the following claims.

I claim:

1. In a disposable razor head equipped with a synthetic resin housing and with at least one metal blade having an exposed cutting edge disposed in a gap in the housing, that improvement which comprises: a partition mounted within the housing in angular relation to the blade and defining in combination with the housing at least one refrigerant means is stored inside a receiving chamber in which a substantial portion of the blade is disposed.

2. A disposable razor head according to claim 1, wherein the partition is mounted within the housing in generally perpendicular relation to the blade.

3. A disposable razor head according to claim 1, wherein the blade and the partition are disposed in spaced relation to one another.

4. A disposable razor head according to claim 1, wherein a neck portion and a handle portion are integrally formed with the razor head to define a disposable safety razor.

5. A disposable razor head according to claim 1, wherein access means are provided in the housing for introducing refrigerant into the refrigerant receiving chamber.

6. A disposable razor head according to claim 5, wherein the access means comprises at least one port extending through the housing into the chamber and a plug removably mounted in the port.

7. In a disposable razor head equipped with a synthetic resin housing and with at least one metal blade having an exposed cutting edge disposed in a gap in the housing, that improvement which comprises: a partition mounted within the housing in angularly adjoining relation to the blade and defining in combination with the housing and blade first and second refrigerant receiving chambers disposed on opposite sides of the blade.

8. A disposable razor head according to claim 7, wherein the blade is formed with at least one passageway therethrough.

9. In a disposable razor head equipped with a synthetic resin housing and with at least one metal blade having an exposed cutting edge disposed in a gap in the housing, that improvement which comprises: a partition having at least one opening extending therethrough, said partition being mounted within the housing in angular relation to the blade and defining in combination with the housing at least one refrigerant receiving chamber in which a substantial portion of the blade is disposed, and a wall mounted within the housing in spaced, generally parallel relation to the partition and defining in combination with the housing and said partition an expansion chamber adjacent to the refrigerant receiving chamber.

10. A disposable razor according to claim 9, wherein a generally fluid tight fit is provided between the blade and the housing adjacent to the cutting edge and the gap.

11. A disposable razor according to claim 10, wherein a film is provided on opposite sides of the blade to establish the fluid tight fit.

* * * * *